US007639785B2

(12) United States Patent
Kirshner et al.

(10) Patent No.: US 7,639,785 B2
(45) Date of Patent: Dec. 29, 2009

(54) COMPACT SCANNED ELECTRON-BEAM X-RAY SOURCE

(75) Inventors: Mark Frederick Kirshner, Redwood City, CA (US); Craig Bisset Wilsen, Redwood City, CA (US); Richard Donald Kowalczyk, San Mateo, CA (US)

(73) Assignee: L-3 Communications Corporation, San Carlos, CA (US)

( * ) Notice: Subject to any disclaimer, the term of this patent is extended or adjusted under 35 U.S.C. 154(b) by 0 days.

(21) Appl. No.: 12/033,836

(22) Filed: Feb. 19, 2008

(65) Prior Publication Data

US 2008/0198970 A1 Aug. 21, 2008

Related U.S. Application Data

(60) Provisional application No. 60/890,986, filed on Feb. 21, 2007.

(51) Int. Cl.
*H05G 1/52* (2006.01)
*H01J 35/30* (2006.01)
*H01J 35/14* (2006.01)

(52) U.S. Cl. ..... 378/137; 378/98.6; 378/113

(58) Field of Classification Search ..... 378/4, 378/10, 92, 98.6, 113–115, 121, 124, 137, 378/138, 19, 9
See application file for complete search history.

(56) References Cited

U.S. PATENT DOCUMENTS 2,673,626 A 3/1954 Bastin
3,946,234 A 3/1976 Hounsfield
4,287,425 A * 9/1981 Elliott, Jr. ..... 378/10
4,598,415 A 7/1986 Luccio et al.
4,644,168 A 2/1987 Rand et al.
4,726,046 A 2/1988 Nunan
4,870,287 A 9/1989 Cole et al.
5,135,466 A 8/1992 Fedorov et al.
5,172,401 A 12/1992 Asari et al.
5,247,556 A * 9/1993 Eckert et al. ..... 378/4
5,490,193 A * 2/1996 Kuroda et al. ..... 378/10
5,504,791 A * 4/1996 Hell et al. ..... 378/10
5,548,630 A * 8/1996 Hell et al. ..... 378/137
5,841,831 A * 11/1998 Hell et al. ..... 378/19
5,995,586 A * 11/1999 Jahnke ..... 378/137
2005/0141669 A1* 6/2005 Shimono et al. ..... 378/137

* cited by examiner

*Primary Examiner*—Allen C. Ho
*Assistant Examiner*—Thomas R Artman
(74) *Attorney, Agent, or Firm*—O'Melveny & Myers LLP

(57) ABSTRACT

A compact, reliable scanning electron-beam x-ray source achieves reduced complexity and cost. In particular, the x-ray source includes an electron beam that is propagated parallel to an x-ray target and is swept across the target in response to a moving magnetic cross field. Rather than scanning the beam by deflecting it about a single point, the point of deflection is translated along the target length, dramatically reducing the volume of the device. The magnetic cross field is translated along the target length using either mechanical systems to move permanent magnets, or electrical systems to energize an array of electromagnets.

18 Claims, 15 Drawing Sheets

PRIOR ART 1604
1602
1620
1608

Increasing time
1632
1636
1640
1644
1658
1630
1634
1638
1642
1646
1648

1650

1632
1636
1640
1644
1630
1634
1638
1642
1652

1654

COMPACT SCANNED ELECTRON-BEAM X-RAY SOURCE

RELATED APPLICATIONS

This application claims the benefit under 35 U.S.C. §119 (e) of U.S. Provisional Application Ser. No. 60/890,986, entitled COMPACT SCANNED ELECTRON-BEAM X-RAY SOURCE, filed Feb. 21, 2007.

BACKGROUND OF THE INVENTION

1. Field of the Invention

The present invention relates to high-energy electron beams, and more particularly, to a scanned electron-beam x-ray source suitable for computed tomography (CT) imaging systems, such as those used in medical and security applications, and for photon backscattering devices, such as those used for subsurface and through-wall detection.

2. Description of Related Art

It is well known in the art to use a high-energy electron beam to generate x-rays. When high-energy electrons strike a metal of high atomic number, their kinetic energy is converted to x-rays. This principle is employed in x-ray vacuum tubes, which typically use a thermionic cathode to emit electrons, and then form the electrons into a high-energy beam via an anode at a large positive potential relative to the cathode. The beam is directed toward a high-atomic-number target, typically tungsten, and the x-rays resulting from the impact are transmitted out of the tube through a vacuum window. In some cases, an additional accelerator section is incorporated between the anode and target to further increase the energy of the beam.

Applications such as CT systems require that the point of origin of the x-rays be scanned around the object to be imaged. This can be achieved by physically moving the x-ray tube, as in rotating gantry CT machines, or by scanning (deflecting) the electron beam across an elongated target. The latter variety of x-ray tube, typically referred to as a scanned electron-beam source, employs focus and deflection coils mounted externally to the vacuum envelope to control the transmission and the cross-section of the beam as it is swept across a linear or curved target. A collimator is generally used to shape the resulting x-ray beam, which, as in point-source x-ray tubes, is transmitted out of the vacuum via a window.

A conventional scanned electron-beam x-ray source uses an electron gun to produce a beam of electrons that passes through a focus coil used to compress the beam to a small diameter. The beam then enters a large vacuum chamber that is tapered such that it has a narrow end at which the electron beam enters the chamber and a wide end at which is located a heavy metal target that produces x-rays when impinged upon by the electron beam. At the point at which the electron beam enters the vacuum chamber, it passes near a deflection coil that can be used to bend the trajectory of the electron beam and cause it to be selectively directed at various portions of the heavy metal target at the far end of the chamber. By causing the beam to bend through various deflection angles, the deflection coil can direct the electron beam to scan along the heavy metal target, producing x-rays that then exit the vacuum chamber through a window. Thus, by applying an appropriate voltage to the deflection coil, the electron beam can be made to move back and forth to sweep out a V-shape or fan shape, producing x-rays at the point at which the electron beam strikes the heavy metal target.

However, because the electron beam must propagate through a vacuum between the deflection coil and the x-ray target, it is necessary that the vacuum chamber itself be quite large. Furthermore, it is often necessary to limit the maximum deflection angle of the electron beam because the large magnetic fields required to produce large deflection angles can result in aberrations that are undesirable for many applications. Thus, in order to scan across a target of a given length with a limited deflection angle, the target must be placed at a significant distance from the deflection coil, necessitating a large vacuum chamber. As the size and complexity of vacuum systems increase, material and manufacturing costs rise, and reliability can be negatively impacted. Furthermore, the anode or accelerating voltage must be tightly regulated to avoid significant deviations in the spot positional accuracy on its track along the target, since the deflection angle is inversely proportional to the beam velocity.

In many applications of scanning x-ray technology, such as luggage screening, it is important to make the scanner as small as possible, maximize reliability and keep costs down. It is therefore desirable to provide a compact, reliable and low-cost scanning x-ray source.

SUMMARY OF THE INVENTION

The invention provides a compact scanned electron-beam x-ray source that has an electron beam that is propagated parallel to the target and swept across the target in response to a moving magnetic cross field. Rather than scanning the beam by deflecting it about a single point, the point of deflection is translated along the target length, dramatically reducing the volume of the device.

This scanning x-ray source may include a high-voltage electron gun with an optional grid for pulsing the beam on and off and controlling the current. An accelerator section and a focus coil serve to focus the emitted electrons into a tightly bunched electron beam. An ion-clearing electrode serves to remove ions from within the vacuum envelope of the electron gun. A linear drift tube is coupled to the electron gun and provides a path for transmission of the electron beam to a collector disposed at the end of the beam travel. An x-ray target is provided that extends along a side edge of the length of the drift tube. A vacuum window extends along a top edge of the drift tube adjacent to the target to define an x-ray scanning dimension. Optionally, the target can be liquid or forced-air cooled. A vacuum pump maintains a vacuum condition within the drift tube. A defocusing coil unfocuses the electron beam at the end of its travel within the drift tube so that it can be evenly distributed within the collector. Lastly, the drift tube may include interlocks to protect the tube, such as a sensor to prevent excessive target dwell time. The collector can be isolated to monitor beam current and additionally operated at depressed potential to recover beam energy. The focus and defocus coils, along with the bending magnet (or magnets), may be mounted outside the vacuum envelope. Multiple x-ray tubes may be deployed to obtain the angular coverage required by a particular application.

In one embodiment of a scanning electron-beam x-ray source in accordance with the present invention, a series of magnets are disposed along the length of the drift tube such that they can selectively induce a magnetic field in the drift tube perpendicular to the direction of travel of the electron beam. When a particular magnet is active, the resulting perpendicular magnetic field through the drift tube causes the electron beam to bend toward the heavy metal x-ray target. By controlling the amplitude and timing of the magnetic field produced by each of the magnets, it is possible to control the point at which the electron beam, propagating along the drift tube, will bend into the x-ray target. Thus, the electron beam can be scanned along the length of the heavy metal target. Because the deflection point moves along the length of the drift tube, the required size of the vacuum chamber remains relatively small, reducing the cost and complexity of the x-ray source.

In another embodiment of a scanning electron-beam x-ray source in accordance with the present invention, a sliding permanent magnet is used to create a moving magnetic field. When held in a fixed position, the permanent magnet creates a magnetic field within the drift tube sufficient to bend the electron beam into the x-ray target that runs along one side of the drift tube. By sliding the permanent magnet along the length of the drift tube, the point at which the electron beam is bent into the target can be varied. Thus, sliding the permanent magnet along the drift tube causes the electron beam to scan along the target and produce a scanning beam of x-rays that exits the drift tube through a window.

In another embodiment in accordance with the present invention, the permanent magnet is mounted on a closed-loop track that is stretched around two pulleys. A drive pulley rotates, pulling a drive belt to which the permanent magnet is attached. As the drive belt draws the permanent magnet along the drift tube, the resulting magnetic field induced within the drift tube causes the point of deflection of the electron beam to move along the length of the drift tube, scanning the electron beam along the x-ray target. While this embodiment may require increased volume to implement, it has the advantage of potentially higher scan rates when compared to the more compact embodiment in which a permanent magnet is mounted to a sliding carriage on the drift tube itself.

In another embodiment of a scanning electron-beam-x-ray source in accordance with the present invention, an array of electromagnets is implemented along the length of the drift tube. By energizing one or more of the electromagnets, a magnetic field is induced within the drift tube sufficient to bend the electron beam into the x-ray target running along the side of the drift tube. By controlling the times at which individual elements of the electromagnet array are energized, any desired scanning profile can be created. This implementation has the advantage of potentially very high scan rates that may exceed those achievable with a mechanically scanned system.

In another embodiment in accordance with the present invention, a number of permanent magnets are arranged azimuthally around a central axle such that each successive permanent magnet along the axle is clocked a few degrees ahead of the preceding one. As the assembly is rotated about the central axis, each permanent magnet is successively brought into a vertical orientation and then rotated away from vertical. The entire assembly is enclosed within a drum constructed of highly permeable magnetic shielding material configured with a slot in the top and bottom of the drum such that a permanent magnet in a vertical position will align with the slots cut in the shielding material. Just outside the drum are a series of magnetic polepieces running along the length of the drift tube. When a permanent magnet is aligned vertically, it completes a magnetic circuit with the polepiece elements situated just through the slots cut in the shielding drum. The completed magnetic circuit thus produces a magnetic field within the drift tube, causing the electron beam to be deflected at that point into the x-ray target. As the central axle to which the permanent magnets are attached is rotated, the particular set of polepieces that are activated by the presence of a vertical permanent magnet between them moves along the drift tube, effectively scanning the electron beam along the x-ray target.

In another embodiment of a scanned electron-beam x-ray source in accordance with the present invention, a pair of elongated polepieces extends along the length of the drift tube and is coupled to an electromagnet. The strength of the magnetic field extending through the drift tube varies as a function of the distance from the electromagnet. In one embodiment, the polepieces may be tapered to enhance the variation of the magnetic field along the length of the drift tube. By varying the amplitude of the current through the electromagnet, the location at which the field through the drift tube is strong enough to bend the electron beam into the target can be varied. Thus, ramping the current through the electromagnet causes the deflection point of the electron beam to scan along the length of the drift tube, creating a scanning x-ray beam, originating at the moving point at which the electron beam strikes the target.

In still another embodiment in accordance with the present invention, a pair of elongated permanent magnets is mounted to an axle that is rotated along the length of the drift tube. This rotation causes the elongated magnets to close like scissors across the drift tube, creating a magnetic field inside the drift tube that moves along the drift tube as the permanent magnets are rotated above and below it. The electron beam propagating inside the drift tube responds to the magnetic field by bending into the x-ray target situated along the drift-tube wall.

In another embodiment in accordance with the present invention, an array of saturable magnetic shunt elements is coupled between permanent magnets and a series of polepieces situated along the length of the drift tube. The saturable shunt elements serve to shield the inside of the drift tube from the field of the permanent magnets by shunting the field and effectively bypassing the drift tube. A controller is used to selectively force the shunt elements into magnetic saturation. As each element is saturated, the magnetic flux from the permanent magnetic is able to penetrate into the drift tube and cause the electron beam to be bent into the x-ray target.

From the foregoing discussion, it should be clear to those skilled in the art that certain advantages of a scanning electron-beam x-ray source have been achieved. Further advantages and applications of the invention will doubtless become clear to those skilled in the art by examination of the following detailed description of the preferred embodiment. Reference will be made to the attached sheets of drawing that will first be described briefly.

DETAILED DESCRIPTION OF THE PREFERRED EMBODIMENT

The invention provides a compact, reliable and low-cost scanning x-ray source that comprises an electron beam that is propagated parallel to the target and swept across the target in response to a moving magnetic cross field. Rather than scanning the beam by deflecting it about a single point, the point of deflection is translated along the target length, dramatically reducing the volume of the device. In the detailed description that follows, like element numerals are used to indicate like elements appearing in one or more of the figures.

Figure 1A:
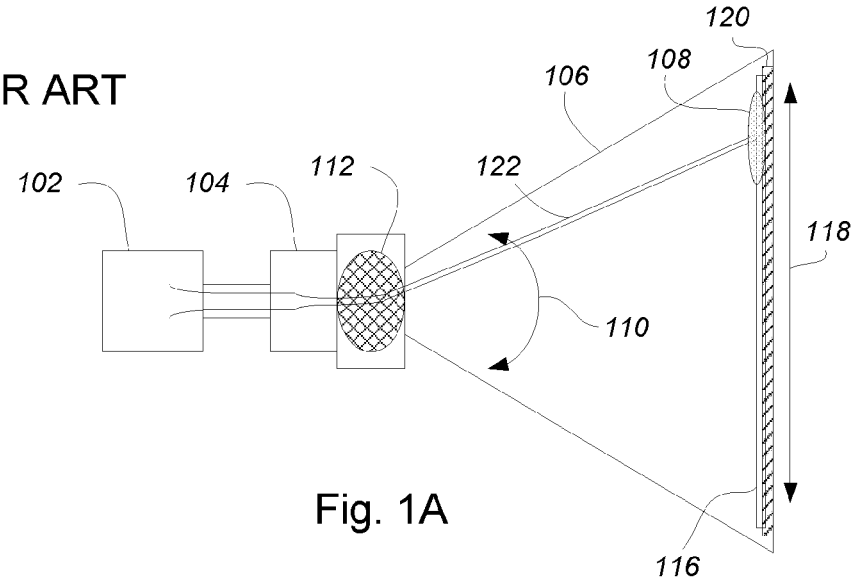
Fig. 1A PRIOR ART
FIGS. 1A and 1B depict a schematic representation of a conventional scanned x-ray tube.
Figure 1B:
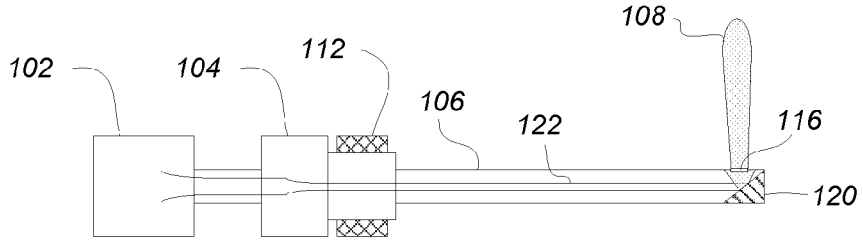

FIGS. 1A and 1B illustrate a conventional scanned electron-beam x-ray source. FIG. 1A provides a plan view, and FIG. 1B depicts an elevation view. An electron gun 102 produces an electron beam 122 that passes through a focus coil 104 that compresses the beam 122 to a small diameter. A large vacuum chamber 106 is located downstream of the focus coil 104. The vacuum chamber 106 has a tapered width such that it is narrow at a proximal end adjacent the focus coil 104 and wide at the distal end that produces the x-ray emissions 108. The tapered width permits a range of deflection angles for the electron beam 122 as illustrated at 110. A deflection magnet coil 112 produces a magnetic field aligned perpendicularly to the electron beam direction so as to deflect the beam upon its entry into the vacuum chamber 106. The magnitude and sign of the magnetic field determines the deflection angle such that the angle can be controlled by applying an appropriate voltage to the deflection magnet coil 112. The distal end of the vacuum chamber 106 includes a target 120 formed of a suitable materials to emit a beam of x-rays 108 upon impact of the high-energy electron beam 122. The x-ray beam 108 passes through a window 116 formed in the vacuum chamber 106, which serves to retain the vacuum within the vacuum chamber. Hence, by controlling the signal applied to the deflection coil 112, the x-ray beam 122 can be scanned laterally along the length of the x-ray scanning direction as illustrated at 118. The deflection coil 112 scans the electron beam from side to side, causing it to track across the target 120 and to generate the x-ray beam 108. Note that the deflection occurs close to the gun 102, sweeping the beam across a broad V-shape as illustrated at 110, necessitating a large vacuum enclosure 106.

Similar to a cathode ray tube (CRT), which uses a set of deflection coils mounted forward of the electron gun, the electron source 102 must be a considerable distance from the target 120 to avoid excessive deflection angles, which can cause beam aberrations. Therefore, in systems scanning across a target of substantial length, a large volume is enclosed by the vacuum chamber. As the size and complexity of vacuum systems increase, material and manufacturing costs rise and reliability can be negatively impacted. Furthermore, the anode or accelerating voltage must be tightly regulated to avoid significant deviations in the spot positional accuracy on its track along the target, since the deflection angle is inversely proportional to the beam velocity.

The invention solves many of the problems of the prior art, particularly by reducing the required volume of the vacuum chamber. In particular, the compact scanned electron-beam x-ray source of the present invention comprises an electron beam that is propagated parallel to the target and swept across the target in response to a moving magnetic cross-field. Rather than scanning the beam by deflection around a single point, the point of deflection is translated along the target length, dramatically reducing the volume of the device.

Figure 2A:
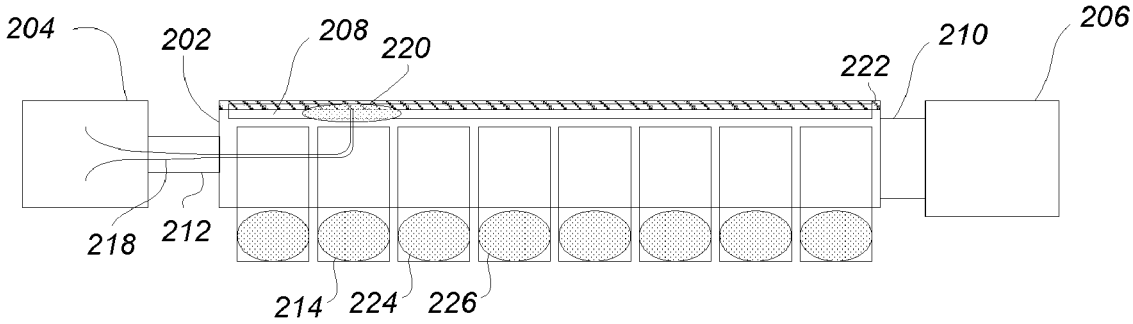
FIGS. 2A and 2B depict a schematic view of a scanned electron-beam x-ray source in accordance with the present invention.
Figure 2B:
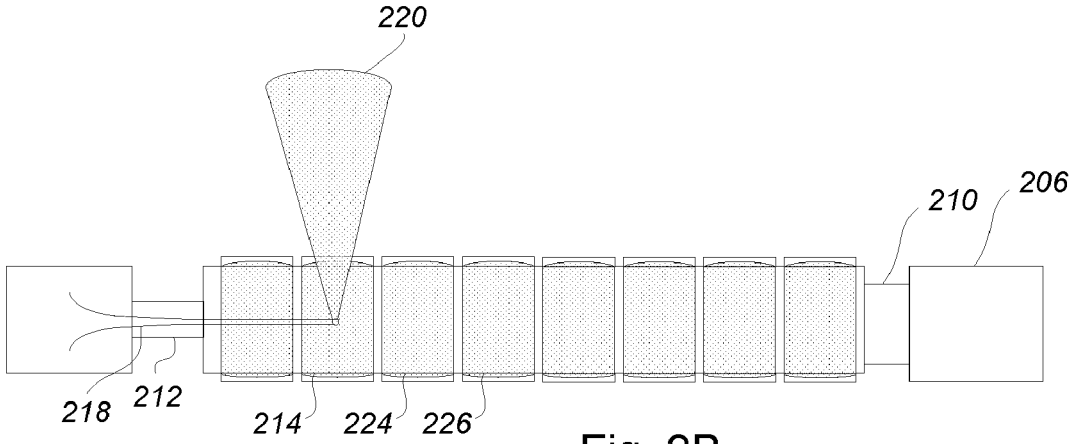

FIGS. 2A and 2B depict a plan view and an elevation view, respectively, of an embodiment of a scanning electron-beam x-ray source in accordance with the present invention. A linear drift tube 202 is coupled to an electron gun 204 and provides a path for transmission of the electron beam 218 to a collector 206 disposed at the end of the beam travel. A focusing coil 212 compresses the electron beam 218 into a compact beam that propagates through the drift tube 202. An x-ray target 222 is provided that extends along a side edge of the length of the drift tube 202. A vacuum window 208 extends along a top edge of the drift tube 202 adjacent to the target 222 to define an x-ray scanning dimension. Optionally, the target can be liquid or forced-air cooled. A vacuum pump maintains a vacuum condition within the drift tube 202. A defocusing coil 210 unfocuses the electron beam at the end of its travel within the drift tube 202 so that it can be evenly distributed within the collector 206. Lastly, the drift tube may include interlocks to protect the tube, such as a sensor to prevent excessive target dwell time. The collector can be isolated to monitor beam current and additionally operated at depressed potential to recover beam energy. A series of bending magnets, e.g., 214, 224, and 226, are positioned adjacent to and along the length of the drift tube 202 in order to bend the electron beam such that it impinges upon the x-ray target 222. The focus 212 and defocus coils 210, along with the bending magnets 214, 224, and 226 may be mounted outside the vacuum envelope. Multiple x-ray tubes may be deployed to obtain the angular coverage required by a particular application.

The bending magnet system 214 causes the electron beam 218 to bend so that it impacts the target 222. The bending magnet 214 utilizes the electron cyclotron motion around the applied magnetic field to rotate the beam 218 into the target 222. In a uniform magnetic cross-field B, the cyclotron frequency is given by:

$$\omega_{ce} = \frac{B \cdot e}{\gamma \cdot m_e}$$

where θ and $m_e$ are the electron charge and rest mass and γ is the relativistic mass factor associated with the beam energy. The gyroradius is related to the cyclotron frequency and the velocity v by:

$$r = \frac{v}{\omega_{ce}}$$

For example, the velocity of an electron beam accelerated to 150 kV is 0.634 c, where c is the velocity of light in a vacuum. Using the preceding equations, the magnetic field that is required to produce a turning radius of one inch is:

$$B = \frac{\gamma \cdot m_e}{e} \cdot \frac{v}{r} = \frac{1.29 \cdot 9.11 \times 10^{-31}}{1.602 \times 10^{-19}} \cdot \frac{0.634 \cdot 3 \times 10^8}{0.0254}$$

which equals 0.055 tesla or 550 gauss. This is a reasonable magnetic field to generate using either permanent magnets or electromagnets.

The bending magnet system is controlled so that the magnetic cross-field progresses down the length of the drift tube 202, sweeping the electron beam across the target 222 and thereby scanning the point-of-origin of the x-rays 220. With reference to FIG. 2A, as the magnetic field moves from magnet 214 to magnet 224 to magnet 226 (or in reverse order), the electron-beam point of impact on the target also moves. The magnetic field need not be controlled at locations substantially beyond the point of impact and too far away to influence the trajectory of the electron beam 218.

Figure 3A:
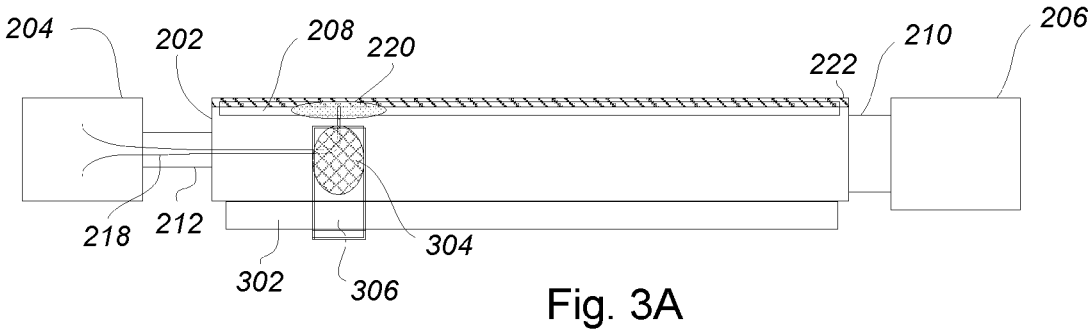
FIGS. 3A and 3B depict a schematic layout of another embodiment of a compact scanned electron-beam x-ray source including a mechanically scanned permanent magnet implemented using a linear slide.
Figure 3B:
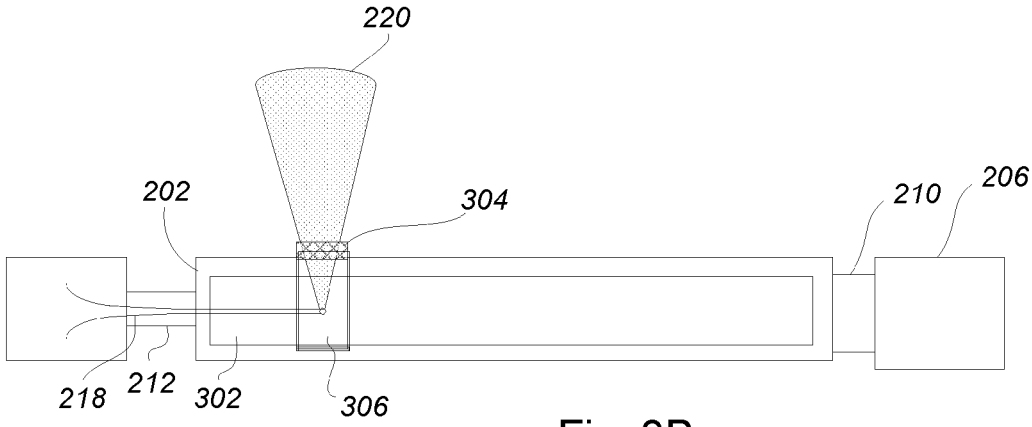

The magnetic field progression along the drift tube can be implemented in a number of ways. FIGS. 3A and 3B depict a plan view and an elevation view, respectively, of an embodiment of a scanned electron-beam x-ray source in accordance with the present invention in which the magnetic field is scanned mechanically. An elongated drift tube 202 includes a linear slide rail 302 along one edge. A permanent magnet 304 is mounted to a sliding carriage 306 that is attached to the linear slide rail 302 and is instrumented to provide positional feedback for calculating the instantaneous x-ray point of origin. In this embodiment, the magnet 304 is physically moved along the length of the drift tube 202 to change the point of impact of the electron beam 218 onto the target 222, thereby sweeping the x-ray beam 220 along the scan dimension. This embodiment is well suited to applications requiring moderate-to-low scan speeds that can be achieved by the physical movement of the magnet 304.

Figure 4A:
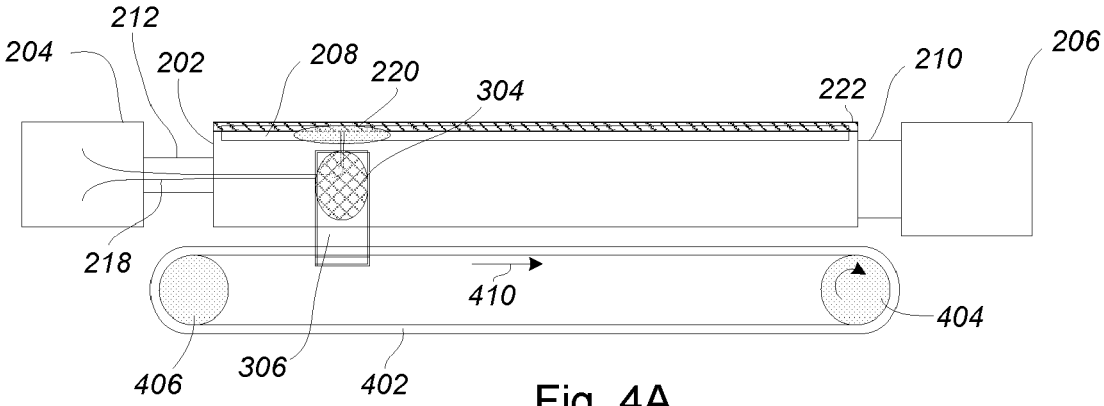
FIGS. 4A and 4B depict a schematic layout of another embodiment of a compact scanned electron-beam x-ray source having a mechanically scanned magnet using a carriage-mounted magnet moving around a closed-loop track.
Figure 4B:
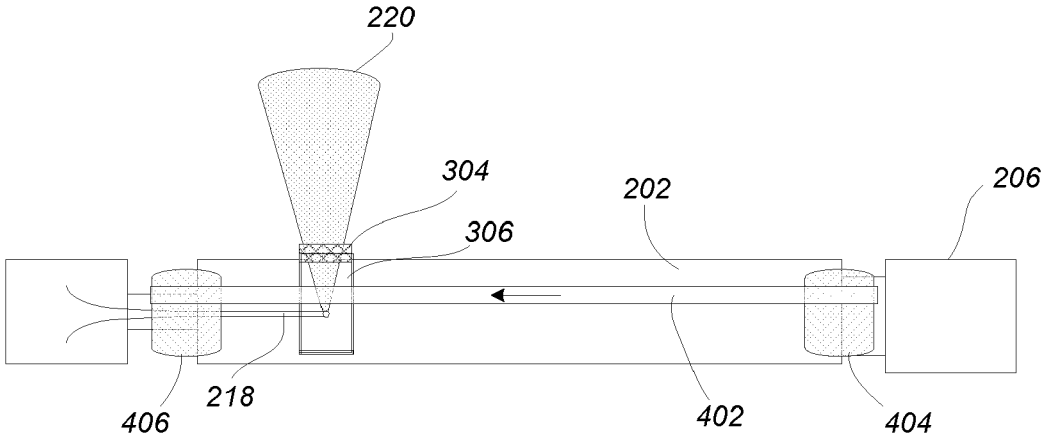

FIGS. 4A and 4B present a plan view and elevation view of an alternative embodiment of a mechanically scanned electron-beam x-ray source in accordance with the present invention that allows for higher scan speeds. This embodiment includes a magnet 304 mounted on a carriage 306 that travels around a closed loop. The carriage 306 is moved linearly 410 along the length of the drift tube 202 using a drive cable 402 that is looped between a drive pulley 404 and an idler pulley 406 and is attached to the carriage 306. When the carriage 306 reaches the drive pulley 404, it is carried around the drive pulley by the drive cable and back to the idler pulley 406, at which point the carriage again positions the magnet 304 adjacent to the drift tube 202 to cause another electron beam scan. This arrangement may enable significantly higher scan rates than those realizable with linear slides, but may require considerably more physical space to implement.

Figure 5A:
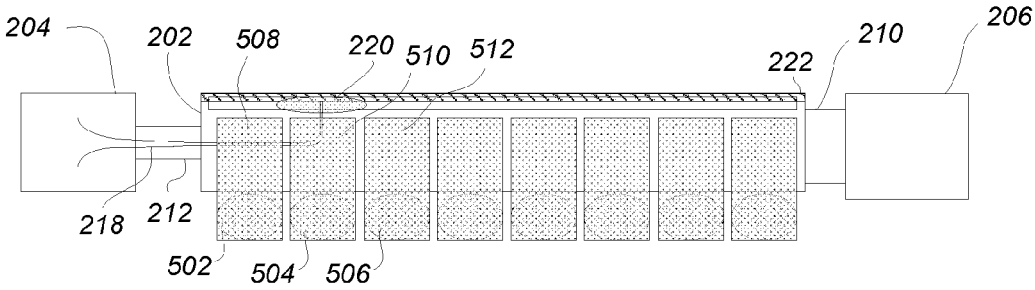
FIGS. 5A and 5B depict a schematic layout of another embodiment of a compact scanned electron-beam x-ray source comprising an electromagnet array.
Figure 5B:
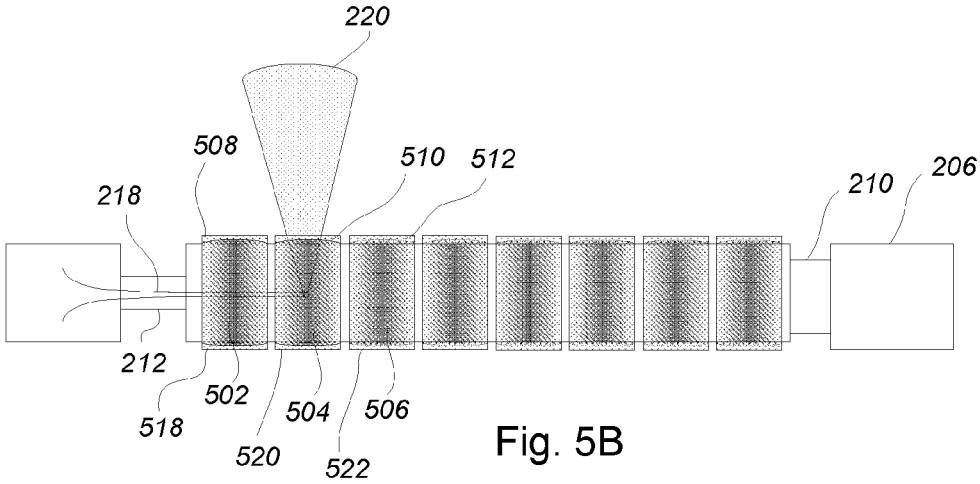

Physical movement of the magnet may be avoided altogether by using a series of electromagnets arranged along the drift tube that are energized sequentially. As shown in plan and in elevation in FIGS. 5A and 5B, a plurality of electromagnets, e.g., 502, 504, and 506, are arranged along the length of the drift tube 202. Each electromagnet is coupled to a corresponding pair of polepieces, e.g., 508 and 518, that serve to complete a magnetic circuit and define a magnetic field region within the drift tube. The electromagnets may be activated serially to achieve the scanning effect. The linear electromagnet array is an attractive solution in applications where high scan rates are required. It is anticipated that scan speeds that exceed the limits of the mechanically scanned system do not pose a technological challenge for the electromagnet array. The elimination of moving parts is also likely to improve reliability. Magnetostatic simulations indicate that the required 550 gauss can be generated using a ferrite-core electromagnet with a modest drive requirement. Control circuitry is used to adjust the current applied to each electromagnet so that the interaction magnetic field travels along the length of the drift tube 202.

Figure 6:
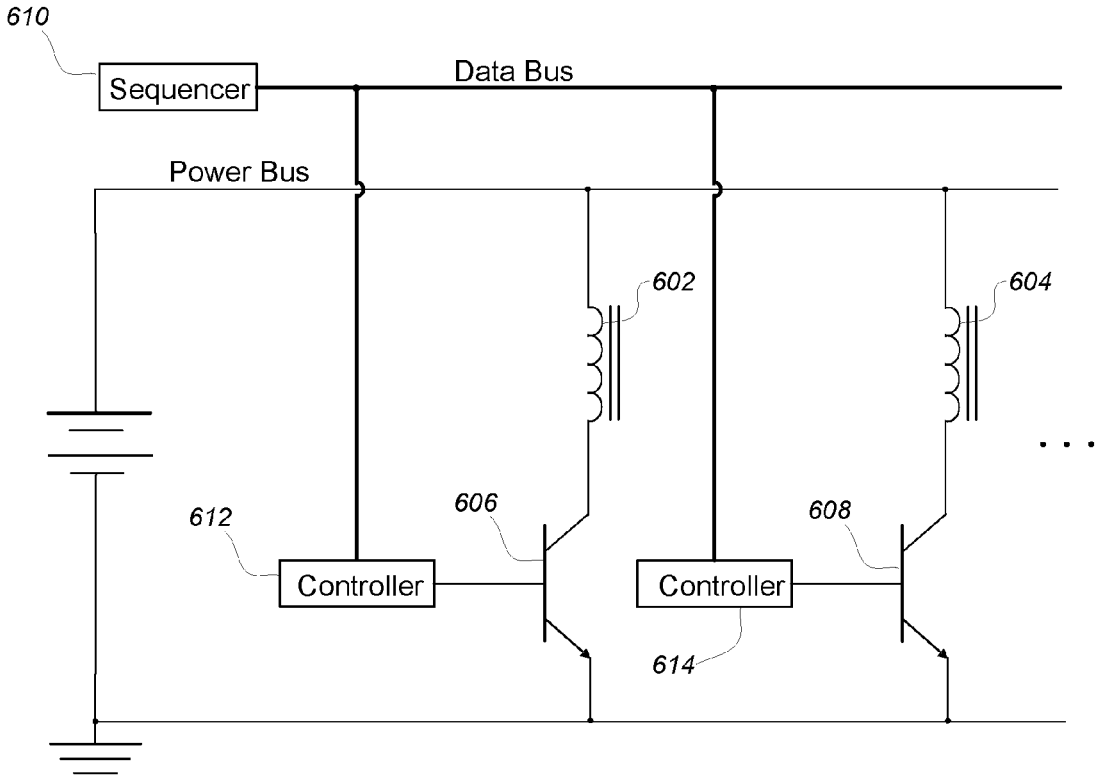
FIG. 6 is an electrical circuit diagram for a bending magnet control system in accordance with the present invention.

An exemplary circuit for the bending magnet control system of an embodiment of an x-ray source in accordance with the present invention is shown in FIG. 6. The first two electromagnets of the bending magnet array are depicted as inductors 602 and 604 coupled to respective drive transistors 606 and 608. A sequencer 610 clocks through a number of discrete time steps selected to describe the evolution of the array drive profile. At each step, an associated controller 612 and 614 uses a look-up table unique to its transistor-electromagnet pair to find the signal to apply to its transistor, which in turn controls the current passing through the associated electromagnet.

Figure 7A:
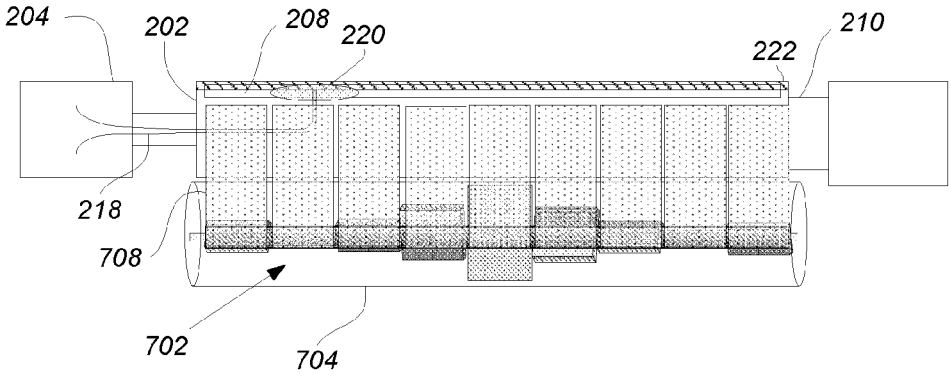
FIGS. 7A and 7B depict a schematic layout of another embodiment of the compact scanned electron-beam x-ray source having a rotating permanent magnet array.
Figure 7B:
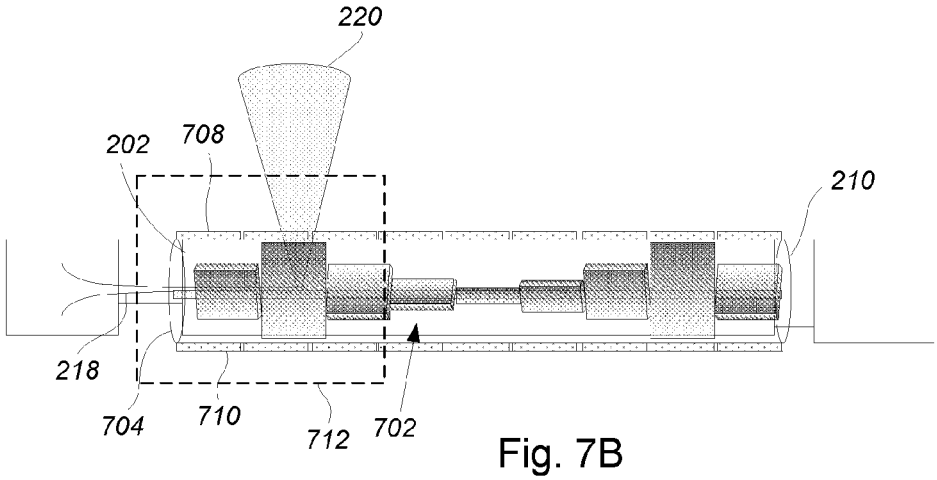
Figure 8:
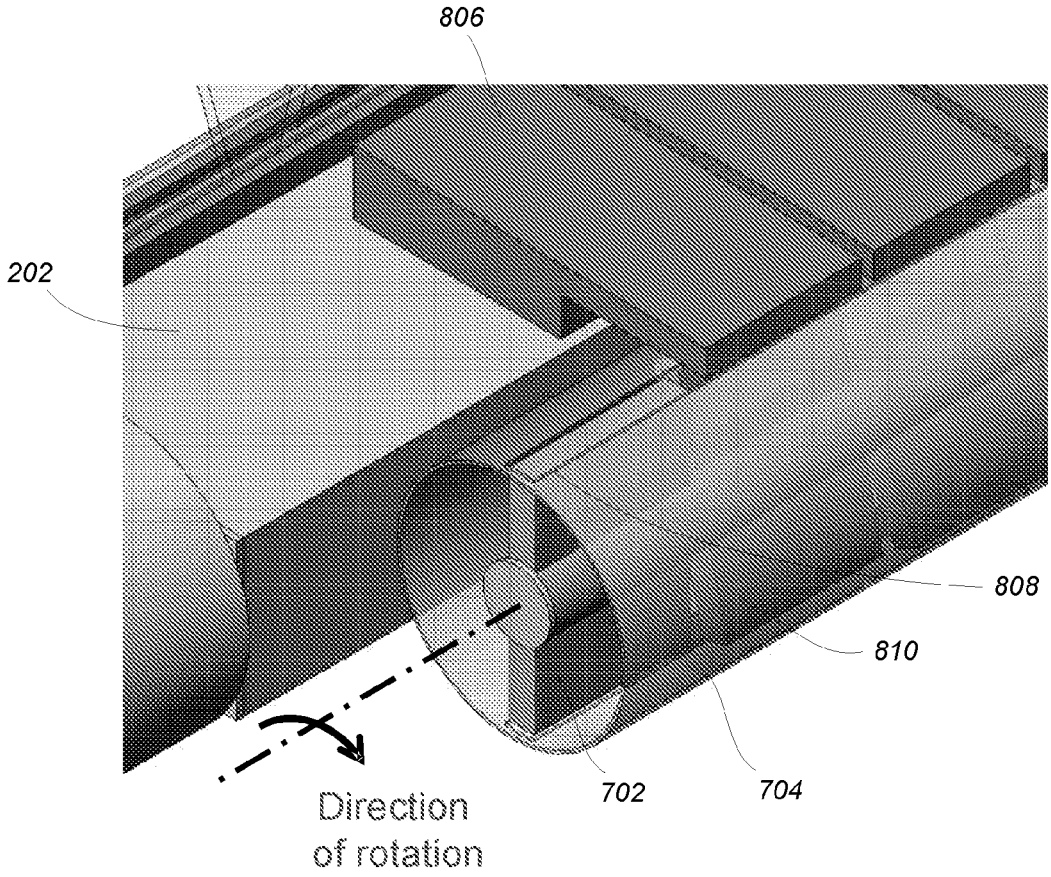
FIG. 8 is a three-dimensional view of the rotating permanent magnet array showing details of the rotating array and the shielding drum.

An additional embodiment of a scanned electron-beam x-ray source in accordance with the present invention is depicted in FIGS. 7A and 7B. In this embodiment, a rotating array of azimuthally arranged permanent magnets 702 is contained within a drum 704 made of highly permeable magnetic shielding material. The drum 704 is positioned adjacent to the drift tube 202 and between a series of polepiece pairs, e.g., 708 and 710, that complete a magnetic circuit with an associated element of the azimuthally arranged array of permanent magnets 702. The area enclosed by the dashed line 712 is depicted as a magnified view in FIG. 8, showing the permanent magnet array 702 and drum 704. The first polepiece has been removed for clarity, and the second polepiece is depicted at 806. A slot along the top 808 and bottom (not shown) of the drum 704 complete the magnetic circuit of a vertical magnet, e.g., 810, through a pair of polepieces, e.g., 806 and its corresponding lower polepiece, and across the drift tube 202. Rotation of the array inside the stationary drum causes the element that is vertical to shift along the drift tube, sweeping the beam across the target.

Figure 9:
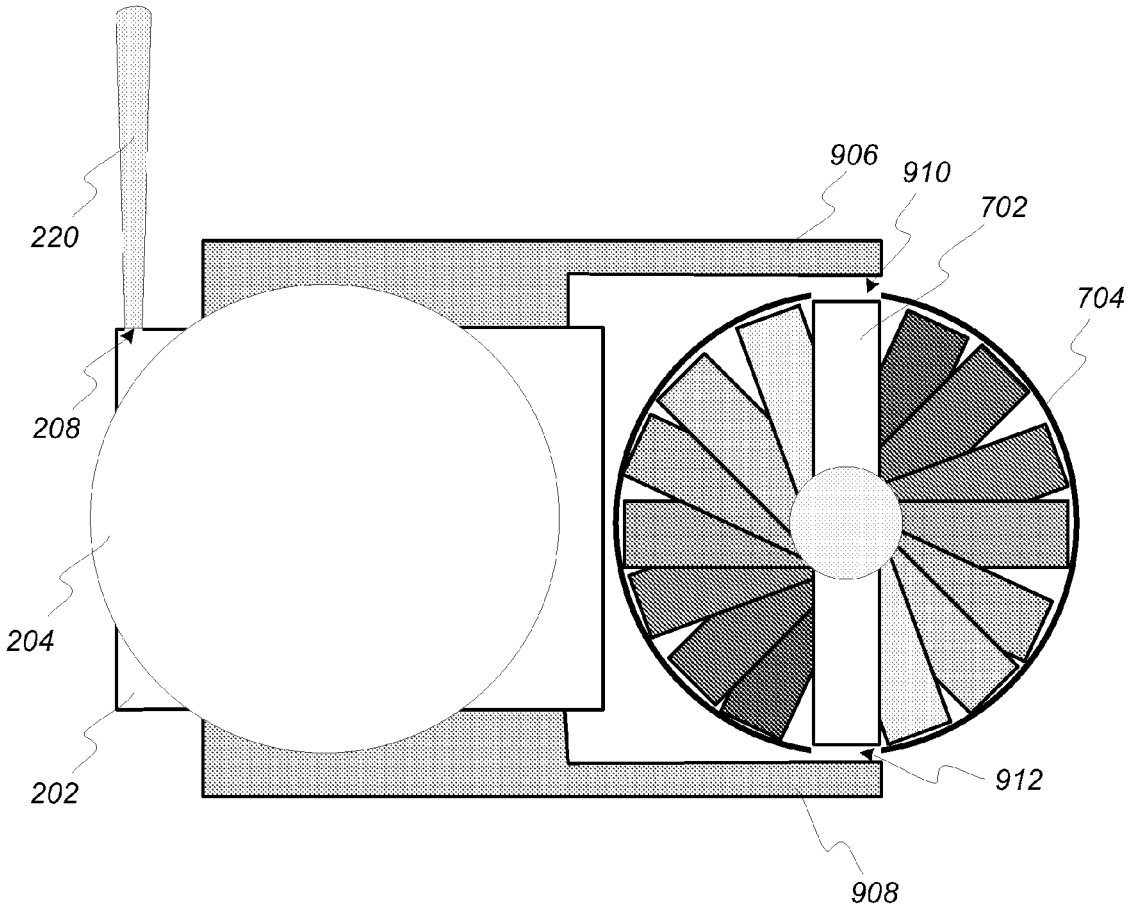
FIG. 9 is an end view of the rotating permanent magnet array showing the angular displacement of the permanent magnet array.

FIG. 9 depicts an additional view of this embodiment illustrating the permanent magnet array 702 contained within the magnetically shielded drum 704. In this depiction, the first magnet of the array is in a vertical orientation, allowing it to align with the slots 910 and 912 cut in the magnetic shield 704, and to complete the magnetic circuit with the upper first polepiece 906 and the lower first polepiece 908.

Figure 10A:
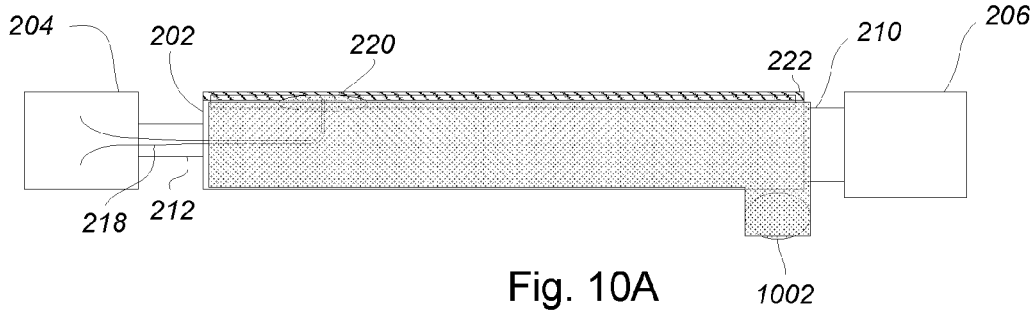
FIGS. 10A and 10B depict a schematic layout of another embodiment of the compact scanned electron-beam x-ray source comprising an electromagnet with extended tapered polepieces.
Figure 10B:
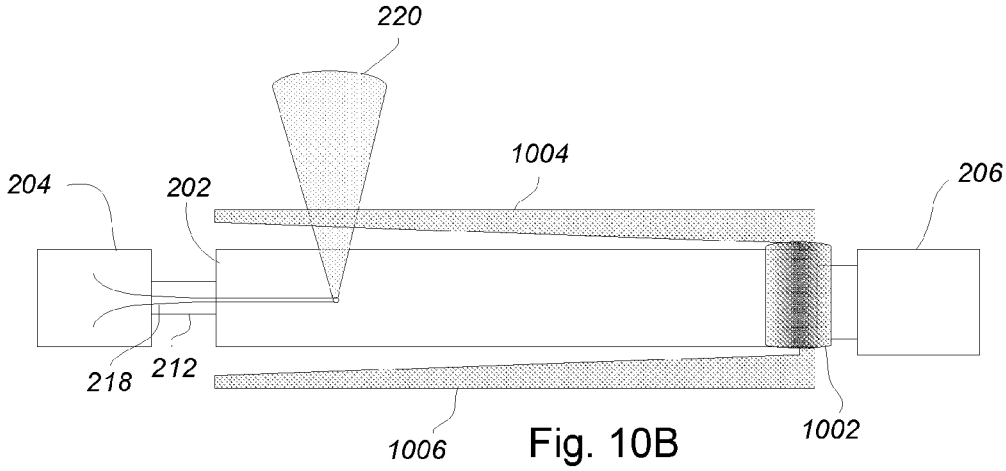

FIGS. 10A and 10B depict a plan and elevation view of another embodiment of a scanned electron-beam x-ray source in accordance with the present invention in which a single powerful electromagnet 1002 with elongated polepieces 1004 and 1006 (jaws) extends down the length of the drift tube 202 toward the gun 204. The electromagnet 1002 will generate a magnetic field between the two polepieces 1004 and 1006. The cross-field is strongest at the end closest to the electromagnet 1002. As the strength of the magnetic field changes, the point at which the cross-field is sufficient to deflect the beam into the target moves along the drift tube. The jaws 1004 and 1006 may be splayed or tapered, as illustrated in FIGS. 10A and 10B, to increase the cross-field gradient down the length of the drift tube 202. The scanning effect is achieved by controlling the power applied to the electromagnet 1002 to change the magnitude of the magnetic field, and thereby alter the deflection point along the length of the polepieces 1004 and 1006.

Figure 11A:
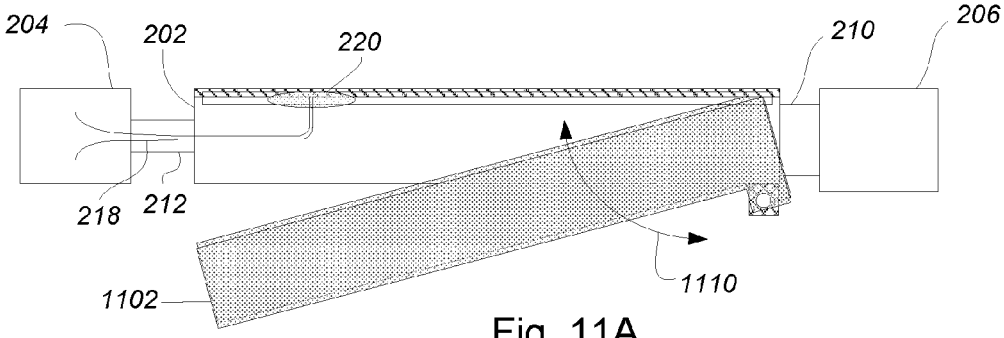
FIGS. 11A and 11B depict a schematic layout of another embodiment of the compact scanned electron-beam x-ray source comprising a set of scissoring permanent magnets.
Figure 11B:
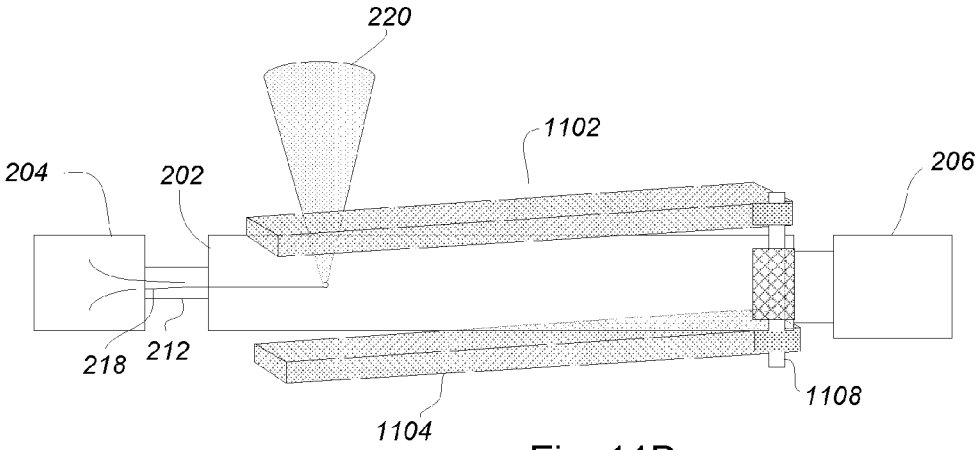

FIGS. 11A and 11B illustrate another embodiment in accordance with the present invention in which two sections of a permanent magnet 1102 and 1104 are mechanically rotated over the drift tube 202 in a scissoring motion to sweep the x-ray beam. A pair of elongated permanent magnets 1102 and 1104 is mounted to an axle 1108 which is rotated across the drift tube 202 as shown at 1110. As the jaws 1102 and 1104 start to overlap the drift tube 202, the cross-field will deflect the beam 218 into the target.

Figure 12A:
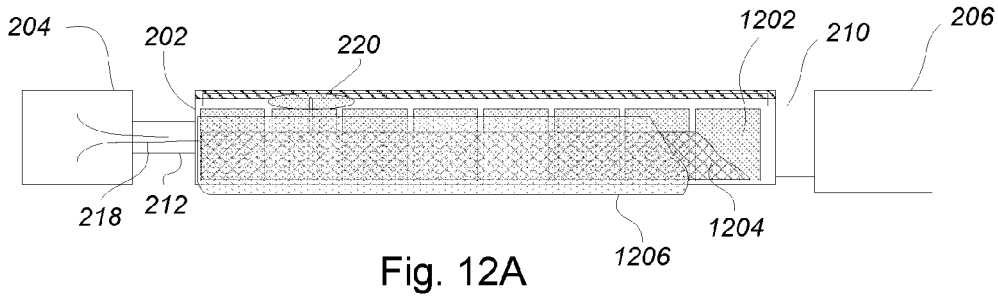
FIGS. 12A and 12B depict a schematic layout of another embodiment of the compact scanned electron-beam x-ray source comprising an array of saturable shunt elements.
Figure 12B:
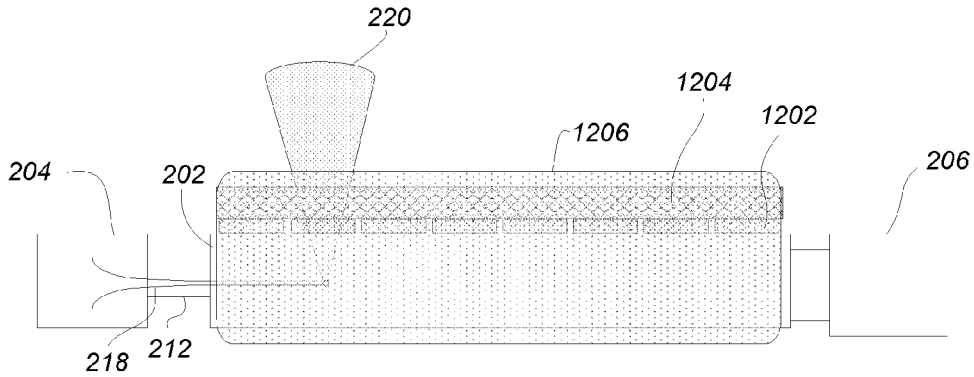
Figure 13:
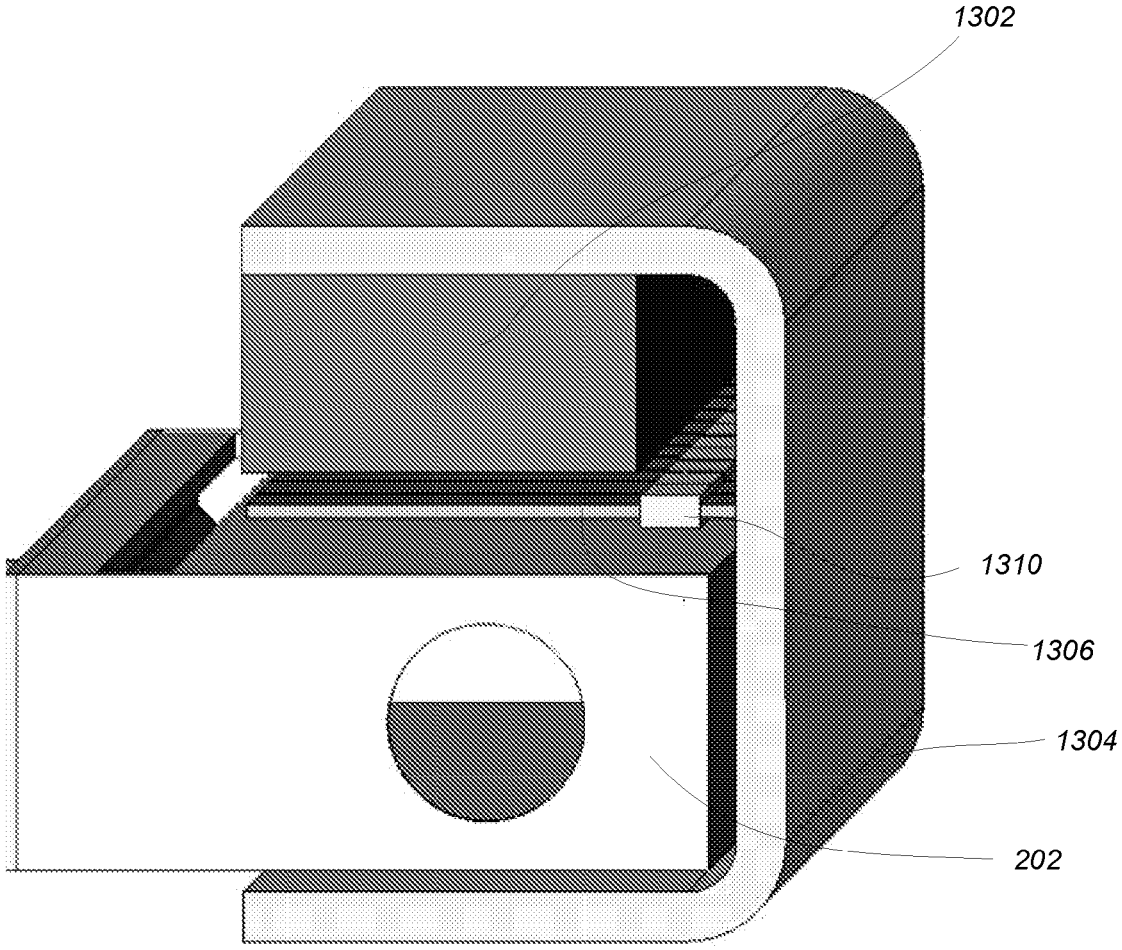
FIG. 13 is an end view of an x-ray source comprising saturable shunt elements, showing the positioning of the shunt elements with respect to the permanent magnets and the drift tube.
Figure 14A:
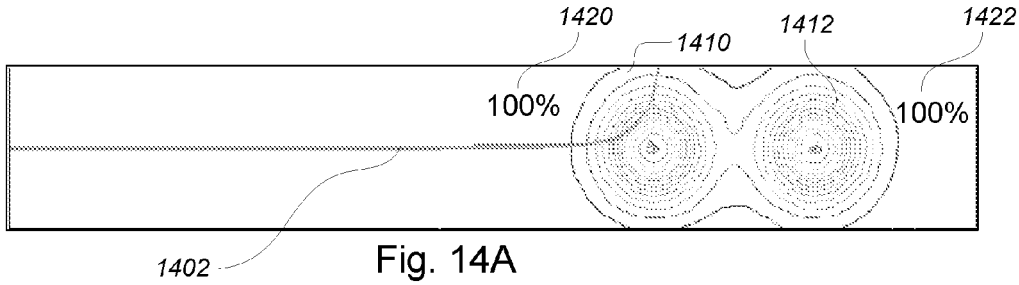
FIGS. 14A-14F illustrate a sequence of beam optics simulations showing the electron beam scanning due to the beam's interaction with two adjacent magnets.
Figure 14B:
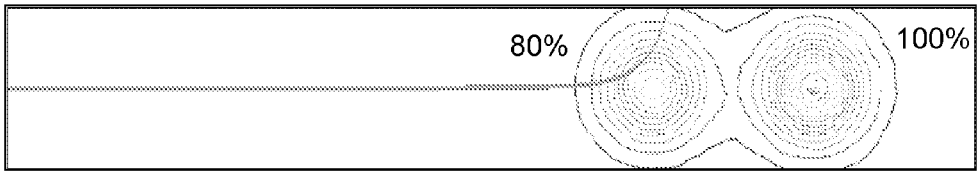
Figure 14C:
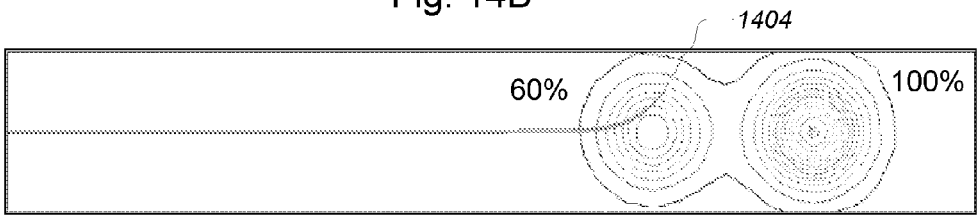
Figure 14D:
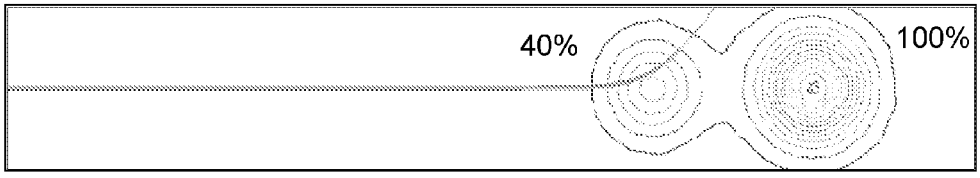
Figure 14E:
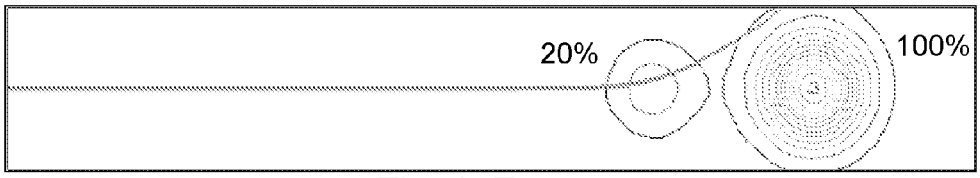
Figure 14F:
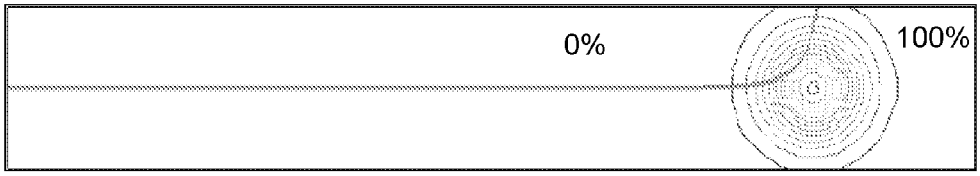

FIGS. 12A, 12B, and 13 illustrate another embodiment of an x-ray source in accordance with the present invention in which an array of saturable magnetic shunt elements, e.g., 1202, is coupled between a permanent magnet 1204 and a polepiece 1206. Note that in FIG. 12A, the right-hand ends of the permanent magnet 1204 and the polepiece 1206 have been cut away for clarity. The saturable shunt elements, e.g., 1202, are arranged serially along the length of the drift tube 202. FIG. 13 shows a cross-section through the drift tube 202, illustrating the saturable shunt element 1306. The saturable shunt element 1306 lies between a permanent magnet 1302 and the drift tube 202. The saturable shunt 1306 shields the drift tube 202 from the magnetic field by returning the magnetic flux through the polepiece 1304. Thus, the electron beam is shielded from the permanent magnet 1302 by the array of saturable elements 1306. A shunt element is driven into magnetic saturation by a controller switch 1310, allowing the permanent magnet flux to penetrate the drift tube 202 to the polepiece 1304 below. By actuating the saturation controller switches 1310 sequentially, the x-ray beam is scanned.

In the foregoing embodiments, the required image resolution and the consequent positional accuracy and scan rate uniformity will influence the electromagnet array design. Design parameters include: (a) the density of the electromagnet array; (b) the drive circuitry, including the amplitude of the current, the rise and fall time of the current pulse and the inductance of the coils; (c) the shape and location of the polepieces, because improvement of the field uniformity by shaping becomes important at the target side of the drift tube where the polepieces cannot extend over the window; (d) the polarity of the magnetic field, since it may be advantageous to drive elements of the magnet array in opposition, i.e., as bucking coils, to cancel undesired flux, sharpen the transition and improve field uniformity; and (e) the global drive profile and its evolution.

FIGS. 14A-14F illustrate a set of electron-beam optics simulations, showing how the electron trajectory 1402 is affected as the field strength of the first of two collinear, circularly shaped bending magnets 1410 and 1412 is gradually reduced. The relative strength of the magnetic field is indicated, e.g., 1420 and 1422, adjacent to the field contour lines of the corresponding bending magnets, 1410 and 1412. The trajectory of the electron beam is depicted schematically, e.g., at 1402. The angle at which the electrons strike the target, e.g., 1404 changes as the field decreases. The coil drive current circuitry can be used to tailor the field decay to optimize the beam sweep rate. Additional magnetostatic simulations have shown that a denser electromagnet array utilizing rectangular polepieces may produce a more favorable field distribution.

Figures 15A, 15B, 15C, 15D, 15E, 15F, 15G, 15H:
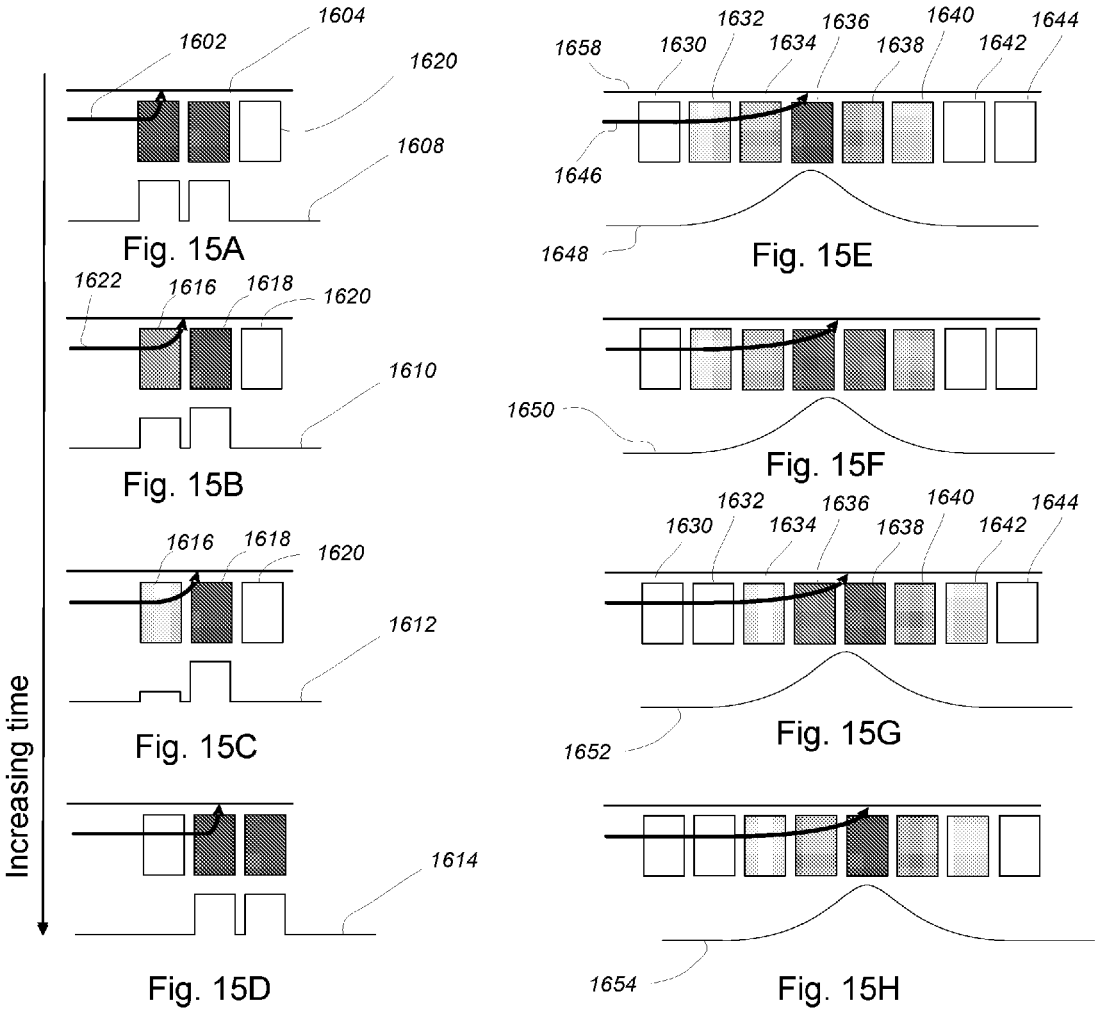
FIGS. 15A-15H illustrate two exemplary magnetic profiles for a linear electromagnet array.

There are a wide variety of global drive profiles that will sweep the beam when applied to the electromagnet array in accordance with the present invention. Two examples of drive profiles are illustrated in FIGS. 15A-D and FIGS. 15E-H. FIGS. 15A-D show a time progression of a stepped drive profile, e.g., 1608, applied to three elements of the magnetic array 1616, 1618, and 1620. The trajectory of the electron beam 1602 is shown schematically as it interacts with the magnetic field produced by the electromagnet array and bends to strike the target 1604. At a first time step, FIG. 15A illustrates a drive profile 1608 in which a strong field is applied to the first two elements 1616 and 1618 of the electromagnet array. At a second time step, FIG. 15B illustrates the field 1610 applied to the first element 1616 being slowly reduced, causing the electron-beam trajectory 1622 to advance. FIG. 15C illustrates a further reduction in field profile 1612 applied to the first element 1616, causing a further advance of the electron beam. Finally, FIG. 15D shows a further time step at which time the drive profile 1614 has removed the drive current from the first array element 1616 and has effectively moved the electron-beam trajectory to the second electromagnet 1618. At this point, the third electromagnet 1620 is also energized. This process is then continued to move the beam to subsequent electromagnetic elements (not shown) in order to scan the electron beam along the array. The process of removing the current from each electromagnet may be controlled according to a profile that is linear in time, or the current may be shut off abruptly, approximating a step function. Other profiles for controlling the removal of current from electromagnet elements may also be employed within the spirit and scope of the invention. Note that this drive method has the advantage of being very simple to control but has the effect of changing the angle at which the electron beam strikes the target as it scans along the target. This characteristic could be disadvantageous for some applications.

The drive approach illustrated in FIGS. 15E-H uses a slightly more complicated drive profile that provides the advantage of a more uniform progression of the electron beam 1646 along the target 1658. The controller calculates a normal field distribution 1648 spread over several magnets, 1630 through 1644, to facilitate a more uniform progression of the field profile. Following this approach, the controller calculates the field intensity at each magnet element according to a Gaussian distribution and then energizes several elements at a time to approximate a distribution that can be reproduced more repeatably along the array, thereby making the shape of the electron-beam trajectory 1648 approximately constant. At each of a series of time steps illustrated at FIGS. 15E through 15H, the controller recalculates the Gaussian profile, shifted by a small distance along the drift tube, and applies the new profile to the magnetic elements. The distance along the drift tube of the peak of the distribution may be calculated to vary linearly with time, or may vary according to any other profile that may be useful for the particular x-ray beam application. FIG. 15E illustrates the peak of the profile 1648 at magnetic element 1636. FIGS. 15F through 15H illustrate that the peak of the distribution gradually moves to electromagnet element 1638. It should be appreciated that many other drive profiles are possible and would fall within the spirit and scope of the present invention.

In CT applications, precise positional control of the x-ray point of origin is required. In conventional scanned-beam x-ray sources, the deflection of the beam occurs close to the electron gun, and extremely tight regulation of the accelerating voltage is necessary. In the present system, however, significantly larger voltage fluctuations are acceptable. For example, if positional accuracy of 0.050 inch is required for a 150 kV beam rotated into a target one inch from the beam axis by a 550-gauss field, the accelerating voltage may deviate by several kilovolts versus a tenth of a kilovolt on a conventional scanned electron-beam source. This results in a significant reduction in the cost of the power supply.

During the period that the high-voltage power supply is not fully regulated, the collector provides a safe place for the beam to dwell. This is not always possible with point-deflection-based systems. The collector on the compact scanned electron-beam x-ray source has the added benefit of potentially preventing damage in the event of loss of power to the bending magnet system. It is also possible to recover energy from the undeflected beam by using a depressed collector.

Finally, it should be noted that the beam can be scanned either from the gun end toward the collector or from the collector end toward the gun. The latter may be preferred, particularly during initial processing when the target is being outgassed. As the beam strikes the target, positive ions will be generated. If the magnetic field is sweeping from the electron gun toward the collector, some of these ions will be channeled by the potential depression generated by the electron beam and accelerated toward the gun where their impact may cause damage to the cathode surface. However, if the magnetic field is sweeping rapidly from the collector end, the end point of the electron beam moves toward the gun ahead of the ions created by its impact with the target. These ions, deprived of the potential depression path will be harmlessly deposited on the grounded target or drift tube. A negatively biased ion-clearing electrode positioned forward from the electron gun will prevent ions from reaching the cathode in the case in which the beam is swept from gun to collector, or in the event that the sweep rate in the collector-to-gun direction is slow enough to give the ions sufficient time to find their way into the potential depression of the beam. This ion trap will also protect the cathode from ions produced by ionization of the background gas. The background gas level can be further reduced by a vacuum pump integrated into the tube design.

Thus, the compact scanned electron-beam x-ray source provides a novel technique for generating a scanning x-ray beam. Several mechanical and electrical implementations have been described which have the potential to significantly reduce size, decrease cost and improve reliability of scanned beam x-ray sources. Similarly, the complexity and cost of associated system-level components, such as the high-voltage power supply and vacuum system, are reduced. Scanning x-ray applications that will immediately benefit from this technology include CT scanners for security and medical systems. The compact scanned electron-beam x-ray source also has the potential to open new markets for x-ray imaging, including low-cost, mobile CT devices. Those skilled in the art will likely recognize further advantages of the present invention, and it should be appreciated that various modifications, adaptations, and alternative embodiments thereof may be made within the scope and spirit of the present invention. The invention is further defined by the following claims.

What is claimed is:

1. An x-ray beam device comprising:

an electron gun adapted to generate an electron beam;

a linear drift tube comprising an input end, an output end, and an evacuated region, wherein the input end is operatively coupled to the electron gun, and the evacuated region is adapted to receive the electron beam from the electron gun;

a target situated along a length of the drift tube and extending in a direction substantially parallel to a direction of travel of the electron beam, wherein the target is adapted to emit x-rays when struck by the electron beam;

at least one bending magnet assembly situated adjacent to the drift tube wherein the at least one bending magnet assembly is adapted to selectively produce a magnetic field extending through the drift tube in a direction substantially perpendicular to the direction of travel of the electron beam to cause the electron beam to selectively bend and strike the target;

a collector operatively coupled to the output end of the drift tube and adapted to collect the electron beam when the at least one bending magnet assembly does not cause the electron beam to bend and strike the target, wherein the collector is electrically isolated and operated at a depressed potential with respect to the target to recover enemy from the electron beam; and a controller adapted to control the at least one bending magnet assembly to cause the magnetic field extending through the drift tube to move along a length of the drift tube in at least one of a first direction from the electron gun to the collector and a second direction from the collector to the electron gun.

2. The x-ray beam device of claim 1, wherein the at least one bending magnet assembly comprises a permanent magnet and a carriage device adapted to mechanically support the permanent magnet, wherein the carriage device is further adapted to slide the permanent magnet along a length of the drift tube.

3. The x-ray beam device of claim 2, wherein the at least one bending magnet assembly further comprises a drive belt operatively connected to the carriage device and adapted to pull the carriage device along a length of the drift tube.

4. The x-ray beam device of claim 1, wherein the at least one bending magnet assembly comprises an electromagnet array.

5. The x-ray beam device of claim 4, wherein the controller is further adapted to selectively apply current to portions of the electromagnet array to cause the magnetic field extending through the drift tube to move along a length of the drift tube.

6. The x-ray beam device of claim 1, wherein the at least one bending magnet assembly comprises:

an electromagnet;

an upper polepiece coupled to the electromagnet; and a lower polepiece coupled to the electromagnet;

wherein the upper polepiece and the lower polepiece produce a magnetic field extending through the drift tube that varies in strength along a length of the drift tube.

7. The x-ray beam device of claim 6, wherein the controller is further adapted to control the amplitude of a current flowing through the electromagnet in order to control a location of a point within the drift tube at which the magnetic field extending through the drift tube is strong enough to bend the electron beam into the target.

8. An x-ray beam device comprising:

an electron gun adapted to generate an electron beam;

a drift tube comprising an input end, an output end, and an evacuated region, wherein the input end is operatively coupled to the electron gun, and the evacuated region is adapted to receive the electron beam from the electron gun;

a target situated along a length of the drift tube and extending in a direction substantially parallel to a direction of travel of the electron beam, wherein the target is adapted to emit x-rays when struck by the electron beam;

at least one bending magnet assembly situated adjacent to the drift tube wherein the at least one bending magnet assembly is adapted to selectively produce a magnetic field extending through the drift tube in a direction substantially perpendicular to the direction of travel of the electron beam to cause the electron beam to selectively bend and strike the target;

a collector operatively coupled to the output end of the drift tube and adapted to collect the electron beam when the at least one bending magnet assembly does not cause the electron beam to bend and strike the target; and a controller adapted to control the at least one bending magnet assembly to cause the magnetic field extending through the drift tube to move along a length of the drift tube in at least one of a first direction from the electron gun to the collector and a second direction from the collector to the electron gun;

wherein the at least one bending magnet assembly comprises:

a rotating permanent magnet array comprising:

a central axle to which is affixed a plurality of permanent magnets, the plurality of permanent magnets configured to be non-collinear; and a drum comprised of a magnetic shielding material and enclosing the plurality of permanent magnets wherein a top slot and a bottom slot are provided in the upper and lower surfaces of the drum; and an array of upper and lower polepieces situated along the drift tube and adjacent to the rotating permanent magnet array such that the array of upper and lower polepieces is substantially aligned with the top slot and the bottom slot in the drum.

9. The x-ray beam device of claim 8, wherein the controller is further adapted to rotate the rotating permanent magnet array about the central axle such that when each of the plurality of permanent magnets reaches a vertical position in line with the top slot and the bottom slot in the drum, a magnetic circuit is completed with a corresponding element of the array of upper and lower polepieces.

10. An x-ray beam device comprising:

an electron gun adapted to generate an electron beam;

a drift tube comprising an input end, an output end, and an evacuated region, wherein the input end is operatively coupled to the electron gun, and the evacuated region is adapted to receive the electron beam from the electron gun;

a target situated along a length of the drift tube and extending in a direction substantially parallel to a direction of travel of the electron beam, wherein the target is adapted to emit x-rays when struck by the electron beam;

at least one bending magnet assembly situated adjacent to the drift tube wherein the at least one bending magnet assembly is adapted to selectively produce a magnetic field extending through the drift tube in a direction substantially perpendicular to the direction of travel of the electron beam to cause the electron beam to selectively bend and strike the target;

a collector operatively coupled to the output end of the drift tube and adapted to collect the electron beam when the at least one bending magnet assembly does not cause the electron beam to bend and strike the target; and a controller adapted to control the at least one bending magnet assembly to cause the magnetic field extending through the drift tube to move along a length of the drift tube in at least one of a first direction from the electron gun to the collector and a second direction from the collector to the electron gun;

wherein the at least one bending magnet assembly comprises:

an upper elongated magnet;

a lower elongated magnet; and an axle operatively coupled to the upper elongated magnet and to the lower elongated magnet.

11. The x-ray beam device of claim 10, wherein the controller is further adapted to rotate the upper elongated magnet and the lower elongated magnet about the axle to selectively position the upper and lower elongated magnets adjacent to the drift tube in order to control a location of a point within the drift tube at which the magnetic field extending through the drift tube is strong enough to bend the electron beam into the target.

12. An x-ray beam device comprising:

an electron gun adapted to generate an electron beam;

a drift tube comprising an input end, an output end, and an evacuated region, wherein the input end is operatively coupled to the electron gun, and the evacuated region is adapted to receive the electron beam from the electron gun;

a target situated along a length of the drift tube and extending in a direction substantially parallel to a direction of travel of the electron beam, wherein the target is adapted to emit x-rays when struck by the electron beam;

at least one bending magnet assembly situated adjacent to the drift tube wherein the at least one bending magnet assembly is adapted to selectively produce a magnetic field extending through the drift tube in a direction substantially perpendicular to the direction of travel of the electron beam to cause the electron beam to selectively bend and strike the target;

a collector operatively coupled to the output end of the drift tube and adapted to collect the electron beam when the at least one bending magnet assembly does not cause the electron beam to bend and strike the target; and a controller adapted to control the at least one bending magnet assembly to cause the magnetic field extending through the drift tube to move along a length of the drift tube in at least one of a first direction from the electron gun to the collector and a second direction from the collector to the electron gun;

wherein the at least one bending magnet assembly comprises:

an array of magnets positioned along a length of the drift tube;

an array of saturable magnetic shunt elements positioned between the array of magnets and the drift tube;

a plurality of saturating switches operatively coupled to corresponding elements of the array of saturable magnetic shunt elements, wherein, each element of the array of saturable magnetic shunt elements is adapted to shunt a magnetic field generated by the array of magnets when corresponding ones of the plurality of saturating switches are opened and to pass the magnetic field when corresponding ones of the plurality of saturating switches are closed.

13. The x-ray beam device of claim 12, wherein the controller is further adapted to selectively open and close ones of the plurality of saturating switches in order to selectively shield and expose portions of the drift tube to a magnetic field produced by the array of magnets positioned along a length of the drift tube.

14. In an x-ray beam device comprising an x-ray target, a linear drift tube, an electron beam propagating through the linear drift tube, and an array of electromagnets positioned adjacent to the linear drift tube, and a collector disposed at an end of the linear drift tube, a method of controlling a magnetic field inside the linear drift tube comprises:

applying a first current to a first element of the array of electromagnets to cause the electron beam to bend into the target at a first location situated near the first element of the array of electromagnets;

applying a second current to a second element of the array of electromagnets;

ramping down the first current through the first element of the array of electromagnets until the current reaches zero to cause the electron beam to bend into the target at a second location situated near the second element of the array of electromagnets;

applying a third current to a third element of the array of electromagnets;

ramping down the second current through the second element of the array of electromagnets until the current reaches zero to cause the electron beam to bend into the target at a third location situated near the third element of the array of electromagnets;

ramping down the third current through the third element of the array of electromagnets until the current reaches zero to cause the electron beam to propagate to the collector, wherein the collector is maintained at a depressed potential voltage with respect to the target; and extracting energy from the electron beam when it is received by the collector.

15. The method of claim 14, wherein the steps of ramping down the flow of current through the first and second elements of the array of electromagnets further comprise ramping down the flow of current in accordance with a profile that decreases linearly with time.

16. The method of claim 14, wherein the steps of ramping down the flow of current through the first and second elements of the array of electromagnets further comprise ramping down the flow of current in accordance with a step function.

17. In an x-ray beam device comprising an x-ray target, a linear drift tube, an electron beam propagating through the linear drift tube, an array of electromagnets positioned adjacent to the drift tube, and a collector disposed at an end of the linear drift tube, a method of controlling a magnetic field inside the linear drift tube comprises:

calculating a first normal distribution of current to apply to each of a plurality of elements of the array of electromagnets such that a peak of the first normal distribution is at a first location along a length of the linear drift tube;

applying corresponding amounts of current consistent with the first normal distribution through each of the plurality of elements of the array of electromagnets to cause the electron beam to bend into the target near the first location along the linear drift tube;

calculating a second normal distribution of current to apply to each of the plurality of elements of the array of electromagnets such that a peak of the second normal distribution is at a second location along the length of the linear drift tube;

applying corresponding amounts of current consistent with the second normal distribution through each of the plurality of elements of the array of electromagnets to cause the electron beam to bend into the target near the second location along the drift tube;

turning off current to the plurality of elements of the array of electromagnets to cause the electron beam to propagate to the collector, wherein the collector is maintained at a depressed potential voltage with respect to the target; and extracting energy from the electron beam when it is received by the collector.

18. The method of claim 17, wherein the step of calculating a second normal distribution of current such that a peak of the second normal distribution is at a second location along the length of the drift tube further includes calculating a shift in location that varies linearly with time.

* * * * *